US005107999A

United States Patent [19]

Canevazzi

[11] Patent Number: 5,107,999

[45] Date of Patent: Apr. 28, 1992

[54] CATHODE-RAY TUBE HAVING IMPROVED 16×9 ASPECT RATIO FACEPLATE

[75] Inventor: Giuliano Canevazzi, Grotta Ferrata, Italy

[73] Assignee: Videocolor S.p.A., Anagni, Italy

[21] Appl. No.: 666,949

[22] Filed: Mar. 11, 1991

[30] Foreign Application Priority Data

Mar. 30, 1990 [IT] Italy ..... 19877 A 90

[51] Int. Cl.[5] ..... H01J 29/86

[52] U.S. Cl. ..... 220/2.1 A; 313/477 R; 313/461; 358/242

[58] Field of Search ..... 220/2.1 R, 2.1 A, 2.3 R, 220/2.3 A; 313/477 R, 461; 358/242, 243, 246, 250, 251, 252, 253, 217

[56] References Cited

U.S. PATENT DOCUMENTS

| | | | |
|---|---|---|---|
| 3,720,345 | 3/1973 | Logue | 220/2.1 A |
| 4,535,907 | 9/1985 | Tokita et al. | 220/2.1 A |
| 4,537,321 | 8/1985 | Tokita | 313/477 R X |
| 4,537,322 | 8/1985 | Okada et al. | 313/477 R X |
| 4,570,101 | 2/1986 | Campbell | 313/461 |
| 4,590,404 | 5/1986 | D'Amato | 313/477 R |
| 4,631,439 | 12/1986 | D'Amato et al. | 313/402 |
| 4,777,401 | 10/1988 | Hosokoshi et al. | 313/477 R |
| 4,786,840 | 11/1988 | Ragland | 313/477 R |
| 4,839,556 | 6/1989 | Ragland | 313/408 |
| 4,881,004 | 11/1989 | Inoue et al. | 313/408 |
| 4,887,001 | 12/1989 | D'Amato et al. | 313/461 |
| 4,893,054 | 1/1990 | Kobayashi | 313/408 |
| 4,924,140 | 5/1990 | Hirai et al. | 313/477 R |
| 4,943,754 | 7/1990 | Hirai et al. | 313/477 R |
| 4,985,658 | 1/1991 | Canevazzi | 313/477 R |

FOREIGN PATENT DOCUMENTS

| | | | |
|---|---|---|---|
| 0283129 | 2/1988 | European Pat. Off. . | |
| 2627625 | 2/1988 | France . | |
| 2634945 | 7/1988 | France . | |
| 0094226 | 4/1984 | Japan | 313/477 R |

*Primary Examiner*—Stephen Marcus
*Assistant Examiner*—Stephen Cronin
*Attorney, Agent, or Firm*—Joseph S. Tripoli; Dennis H. Irlbeck

[57] ABSTRACT

The present invention provides an improvement in a cathode-ray tube that includes a rectangular faceplate having two long sides and two short sides wherein the ratio of the length of the long sides to the length of the short sides is approximately 16 to 9. The tube includes a major axis which parallels the two long sides and a minor axis which parallels the two short sides. The improvement comprises the ratio of the equivalent radius of the faceplate curvature along the major axis to the equivalent radius of the faceplate curvature along the minor axis being in the approximate range of 1.5 to 1.6, the ratio of the equivalent radius of the faceplate curvature along the long sides of the faceplate to the equivalent radius of faceplate curvature along the major axis being in the approximate range of 1.12 to 1.15, and the ratio of the equivalent radius of the faceplate curvacute along the long sides of the faceplate to the equivalent radius of faceplate curvature along the short sides being in the approximate range of 1.30 to 1.36.

5 Claims, 4 Drawing Sheets

CATHODE-RAY TUBE HAVING IMPROVED 16×9 ASPECT RATIO FACEPLATE

This invention relates to cathode-ray tubes (CRT's) and, particularly, to the surface contours of the viewing faceplates of such tubes having approximately 16×9 aspect ratios.

BACKGROUND OF THE INVENTION

There are several different faceplate contours presently used in CRT's having 4×3 aspect ratios. The two most common contours are spherical and cylindrical. Other contours in use include biradial and more complex variations of biradial contours. Recently, development of tubes having aspect ratios of 16×9 has begun. Presently, there is a need for a design of a faceplate contour for CRT's having 16×9 aspect ratios that will meet certain requirements, such as those needed for high definition television (HDTV).

A cathode-ray tube, such as a color picture tube, must have several features if it is to be useful for HDTV. First, the faceplate contour of such tube should be as flat as practicable. The tube must have sufficient resolution to meet any future HDTV standard. The tube also must have good color purity and white uniformity at high electron beam current density. It is desirable that the tube have an optimized raster geometry to eliminate the need for extra circuitry to correct for raster distortion. The tube should have good implosion protection, while using glass having minimum thickness to reduce cost and tube weight. Finally, the tube should be usable for both line and dot screens.

The above features are somewhat related and have an effect on faceplate contour and on faceplate panel design. (A faceplate panel includes a faceplate as well as a peripheral sidewall that extends from the faceplate.) Some of the desired features are inconsistent with other features in that, in providing for one feature, another feature is adversely affected. The present invention provides a faceplate contour that is a compromise to ensure that all of the above features are attainable to some extent, although any particular feature may not be optimized.

In the present specification and claims, the term "equivalent radius" is used. Use of this term is not meant to imply that the contour curvature of any cross-section of a faceplate is circular. Such contours are more complex and can only be defined by the equations presented herein As used, the term "equivalent radius" indicates a circle that touches the center of a faceplate and the extremes of the faceplate at the border of the viewing screen.

SUMMARY OF THE INVENTION

The present invention provides an improvement in a cathode-ray tube that includes a rectangular faceplate having two long sides and two short sides, wherein the ratio of length of the long sides to the length of the short sides is approximately 16 to 9. The tube includes a major axis which parallels the two long sides and a minor axis which parallels the two short sides. The improvement comprises the ratio of the equivalent radius of the faceplate curvature along the major axis to the equivalent radius of the faceplate curvature along the minor axis being in the approximate range of 1.5 to 1.6, the ratio of the equivalent radius of the faceplate curvature along the long sides of the faceplate to the equivalent radius of the faceplate curvature along the major axis being in the approximate range of 1.12 to 1.15, and the ratio of the equivalent radius of the faceplate curvature along the long sides of the faceplate to the equivalent radius of the faceplate curvature along the short sides being in the approximate range of 1.30 to 1.36.

DETAILED DESCRIPTION OF THE PREFERRED EMBODIMENTS

Figure 1:
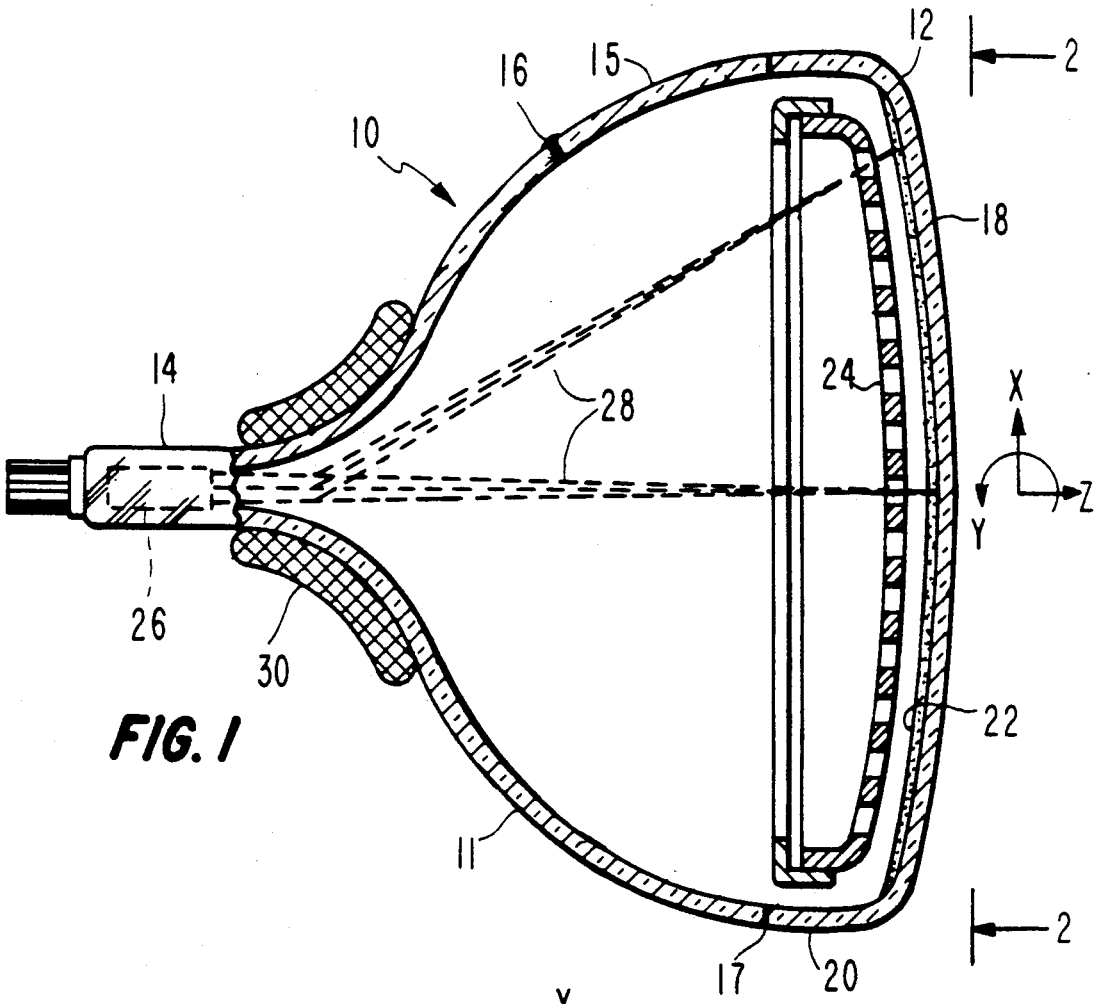
FIG. 1 is a side view, partly in axial section, of a shadow mask color picture tube incorporating one embodiment of the present invention.

FIG. 1 shows a rectangular color picture tube 10 having a glass bulb or envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a rectangular viewing faceplate 18 and a peripheral flange or sidewall 20 which is sealed to the funnel 15 by a glass frit 17. A three-color phosphor screen 22 is carried by the inner surface of the faceplate 18. The screen 22 preferably is a line screen with the phosphor lines arranged in triads, each triad including a phosphor line of each of the three colors. Alternatively, the screen can be a dot screen, and it may or may not include a light-absorbing matrix. A multi-apertured color selection electrode or shadow mask 24 is removably mounted in predetermined spaced relation to the screen 22. An electron gun 26, shown schematically by dashed lines in FIG. 1, is centrally mounted within the neck 14 to generate and direct three electron beams 28 along convergent paths through the mask 24 to the screen 22.

The tube of FIG. 1 is designed to be used with an external magnetic deflection yoke, such as the yoke 30 shown in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is at about the middle of the yoke 30. Because of fringe fields, the zone of deflection of the tube extends axially from the yoke 30 into the region of the gun 26. For simplicity, the actual curvatures of the deflected beam paths in the deflection zone are not shown in FIG. 1.

Figure 2:
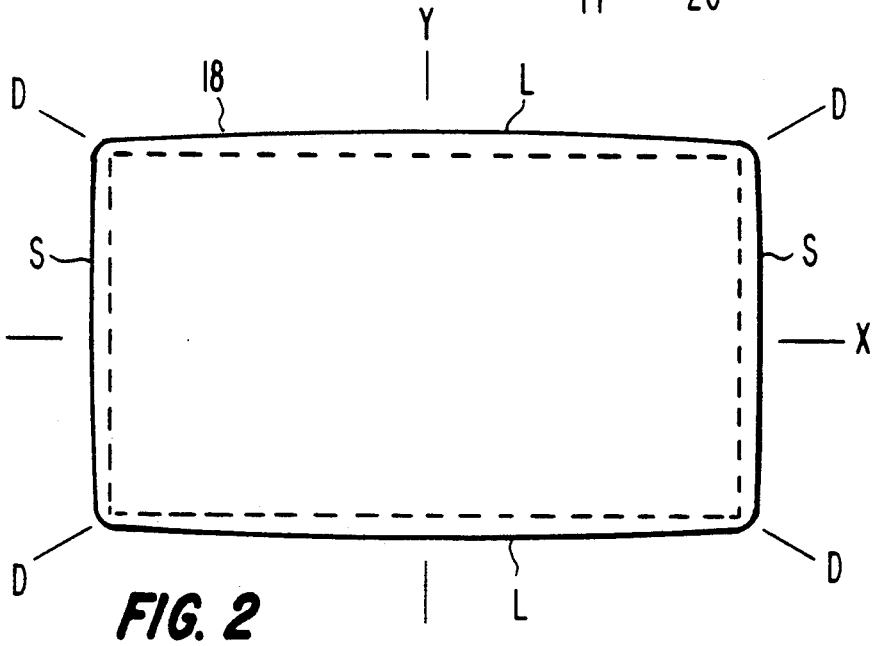
FIG. 2 is a front view of the faceplate of the tube of FIG. 1.

As shown in FIG. 2, the rectangular faceplate 18 includes two orthogonal axes, a major axis X and a minor axis Y, and diagonals D. The two long sides, L, of the faceplate 18 substantially parallel the major axis X, and the two short sides, S, substantially parallel the minor axis Y.

Figure 3:
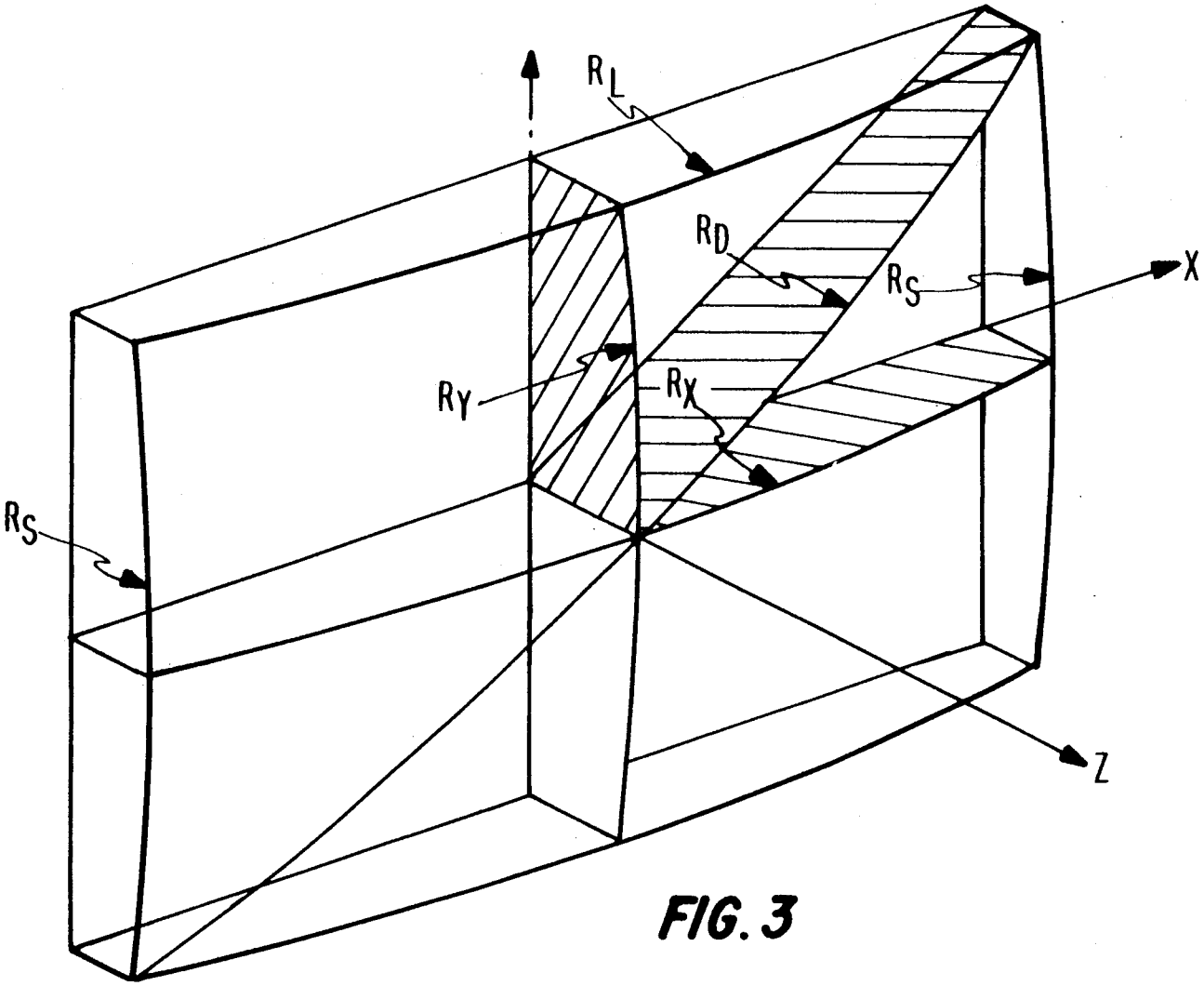
FIG. 3 is a perspective line drawing of the inside surface of the faceplate of FIG. 2.

FIG. 3 shows the principal equivalent radii of the inner surface of the faceplate 18. The major axis equivalent radius is designated $R_X$, and the minor axis equivalent radius is designated $R_Y$. The equivalent radius of each of the long sides of the faceplate is designated $R_L$, and the equivalent radius of each of the short sides is designated $R_S$. The equivalent radius of each of the faceplate diagonals is designated $R_D$.

The contour of the inner surface of the faceplate 18 is defined by the following equation.

$$Z=C(1)X^2+C(2)X^4+C(3)Y^2+C(4)X^4Y^2+C(5)Y^4 \quad \text{(Equation 1)}$$

where:

Z is the distance from a plane tangent to the center of the inner surface contour.

X and Y represent distances from the center, in the directions of the major and minor axes, respectively.

C(1) to C(5) are coefficients that depend on the diagonal dimension of the faceplate.

For a tube faceplate with a viewing screen having a diagonal dimension of 66 cm, the preferred coefficients C(1) to C(5) are as shown in Table I. The X and Y dimensions must be in millimeters to use the coefficients of Table I.

TABLE I

| | |
|---|---|
| C(1) = | $0.338678 \times 10^{-03}$ |
| C(2) = | $0.629894 \times 10^{-09}$ |
| C(3) = | $0.603681 \times 10^{-03}$ |
| C(4) = | $-0.222411 \times 10^{-13}$ |
| C(5) = | $0.172513 \times 10^{-09}$ |

Equation 1, utilizing the values for C(1) to C(5) given in Table I, defines a faceplate contour embodiment for a 66 cm diagonal tube that is within the scope of the present invention. The contour of other size tubes within the scope of the present invention can be determined by scaling the coefficients C(1) to C(5), using the following equation.

$$C'(I)=K\Sigma C(I)\pi F^{[J(I)+L(I)-1]} \quad \text{(Equation 2)}$$

where:

C'(I) is a modified coefficient for the other size tube.

C(I) is the corresponding coefficient from Table I.

F is a scale factor equal to the viewing diagonal of the other size tube, in cm, divided by 66 cm.

K is a factor that changes the curvature of the inside surface contour of the faceplate and which is either 1 or close to 1.

J(I) and L(I) are the respective powers of X and Y associated with the coefficients C(1) to C(5) in Equation 1.

Utilizing Equation 2, Equation 1 can be rewritten in the generalized form as follows.

$$Z=\Sigma_I C(I)\Sigma K/F^{J(I)+K(I)-1}\Sigma X^{J(I)}\Sigma Y^{K(I)} \quad \text{(Equation 3)}$$

Equation 3 describes a family of 16/9 panel faceplates of any size (if scaled up and down with scale factor F) and of sufficient planarity, if the planarity factor K is selected between:

$$0.95<K<1.10$$

K=1 applies to an A66 16/9 reference tube.

K<1 indicates a faceplate flatter than the reference tube.

K>1 indicates a faceplate more curved than the reference tube.

For example, in a tube having a 76 cm viewing diagonal, the scale factor F equals 76/66. If K is made greater than 1, such as 1.05, the contour of the faceplate will be slightly more curved than the 66 cm faceplate. When K is made less than 1, the faceplate will be less curved than the 66 cm faceplate.

Figure 4:
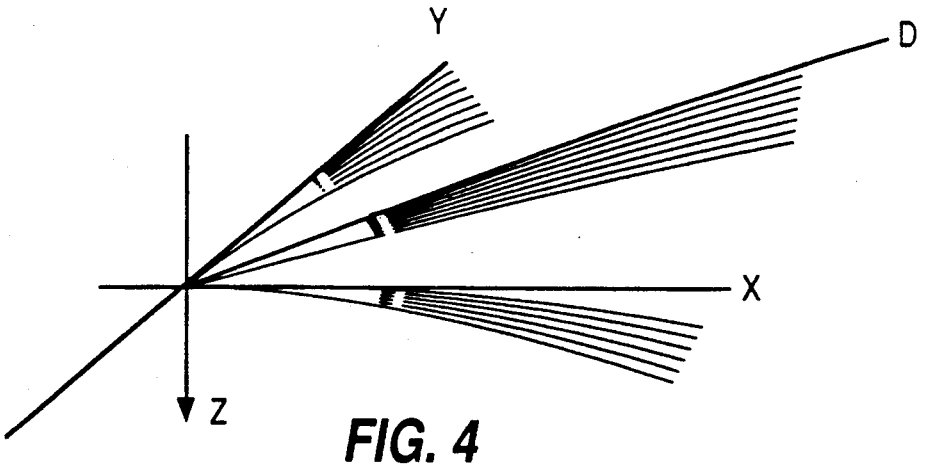
FIGS. 4, 5 and 6 are perspective line drawings of families of faceplate contour embodiments that are included within the scope of the present invention.
Figure 5:
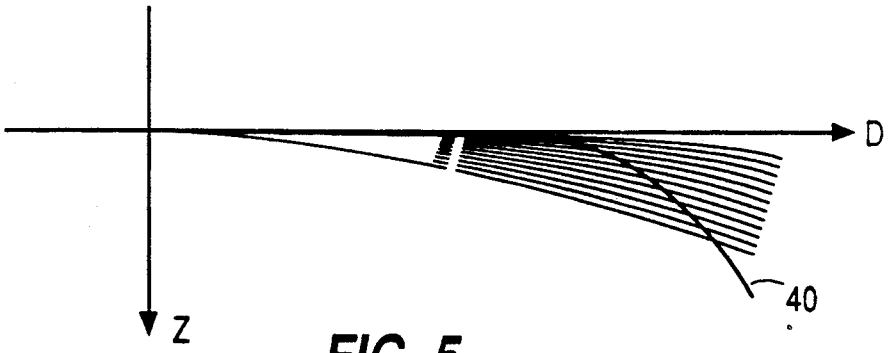
Figure 6:
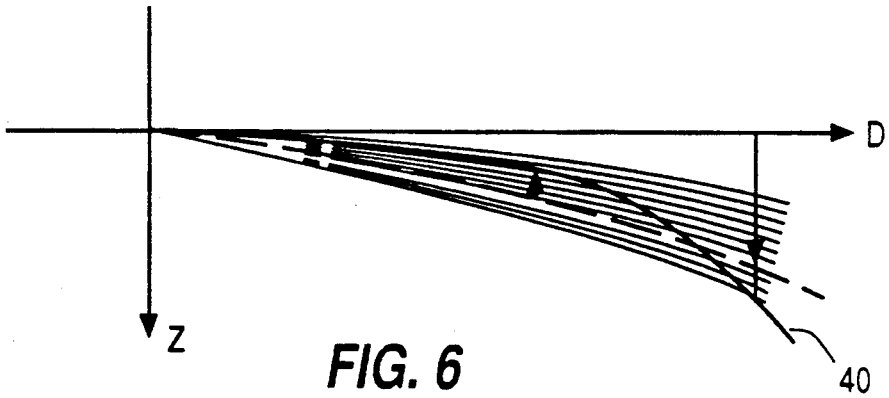

For a selected size such as 66 cm, where F=1, if the K factor is changed between 0.95 and 1.10, a group of faceplates is described that are distributed inside a precise range, "cloud" or cluster, as shown in FIG. 4. It is to be understood that some deviation from the precise curves shown may be possible while still staying within the scope of the present invention. For example, a faceplate curve 40 is shown in a diagonal range in FIG. 5. The faceplate has a 66 cm diagonal, hence F=1, but Equation 1 is slightly modified to vary the curve 40 from the other curves in the cluster. It is desirable to determine whether the curve 40 represents a faceplate contour that utilizes the present invention or whether it represents some other type of contour that is outside the scope of the present invention. To do this determination, the curve 40 is compared to the closest curve shown within the cluster. The closest curve is the one within the cluster that has the minimum delta d differences with that of the curve 40. The most convenient faceplate curve to be compared with the curve 40 is the one for which the maximum positive d equal to maximum negative d, i.e., d(+)=d(−), as shown in FIG. 6. Along the diagonal section of FIG. 6, d is computed in many X, Y locations of the faceplate. For the curve 40 to be within the scope of the present invention, the values for delta d must not exceed a reasonable value or tolerance e.

$$|d|\leq e$$

This tolerance is herein defined to be 2.5% of the maximum drop, $Z_D$, from center-to-end along the diagonal.

$$e=0.025\ Z_D$$

For the 66 cm tube having a 16/9 aspect ratio, $Z_D$ equals 41.27 mm. Therefore, $$e=0.025\ \Sigma 41.27=1.3\ \text{mm}$$

There are certain approximate ratios that appear to be critical for attaining the optimum contour compromise discussed originally. One of these ratios is the ratio of the equivalent radius, $R_X$, along the major axis X to the equivalent radius, $R_Y$, along the minor axis Y. The preferred range for this ratio $R_X/R_Y$ is 1.5 to 1 6. Another ratio is the ratio of the equivalent radius, $R_L$, of the long side of the contour to the equivalent radius, $R_S$, of the short side of the contour. The preferred range for this ratio $R_L/R_S$ is 1.30 to 1.36. A third ratio is the ratio of the equivalent radius, $R_L$, of the long side to the equivalent radius, $R_X$, along the major axis. The preferred range for this ratio $R_L/R_X$ is 1.12 to 1.15. Equations 1, 2 and 3, with the coefficients given above, provide an inner surface faceplate contour that falls within these critical ratios.

Using the contour of Equation 1 with the coefficients of Table I for a 66 cm diagonal tube, the various equivalent radii of the faceplate inner contour are as given in Table II.

TABLE II

| |
|---|
| $R_X$ = 1295 mm |
| $R_Y$ = 830 mm |
| $R_L$ = 1476 mm |
| $R_S$ = 1107 mm |

The ratios for the above-defined 66 cm tube are: $R_X/R_Y=1.56$, $R_L/R_S=1.33$ and $R_L/R_X=1.14$.

Figure 7:
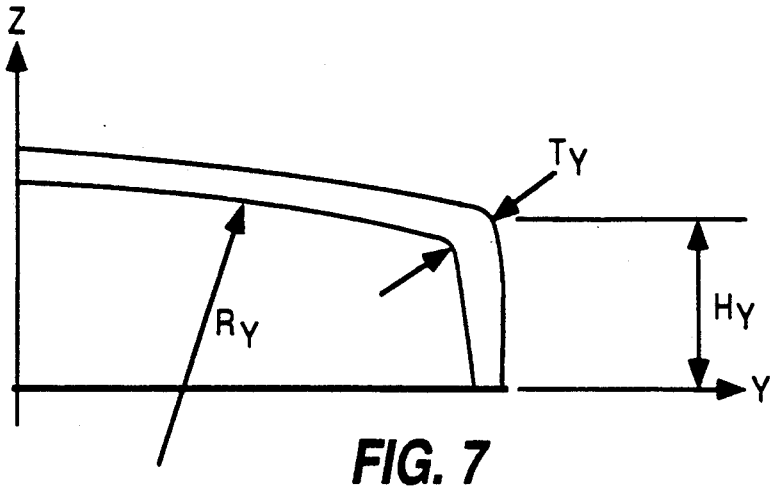
FIGS. 7, 8 and 9 are cross-sectional views of half of the faceplate of FIG. 2, taken along the minor axis, the major axis and the diagonal of the faceplate, respectively.
Figure 8:
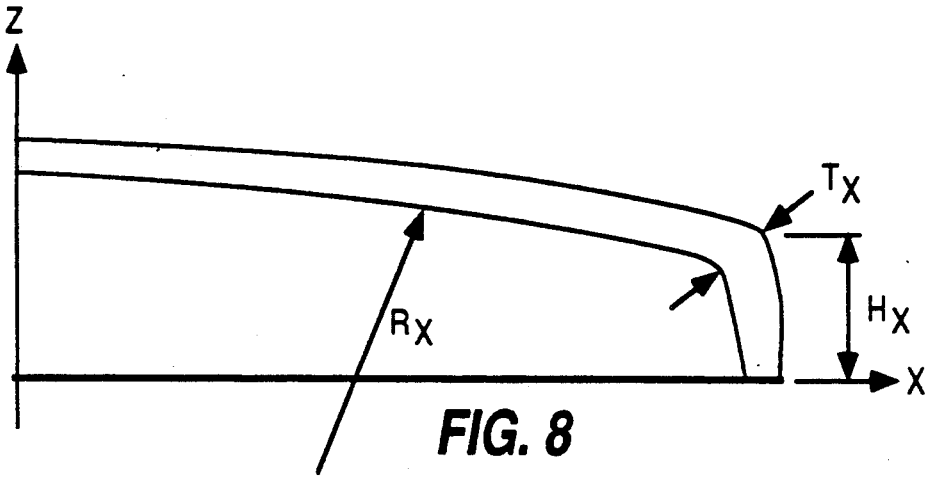
Figure 9:
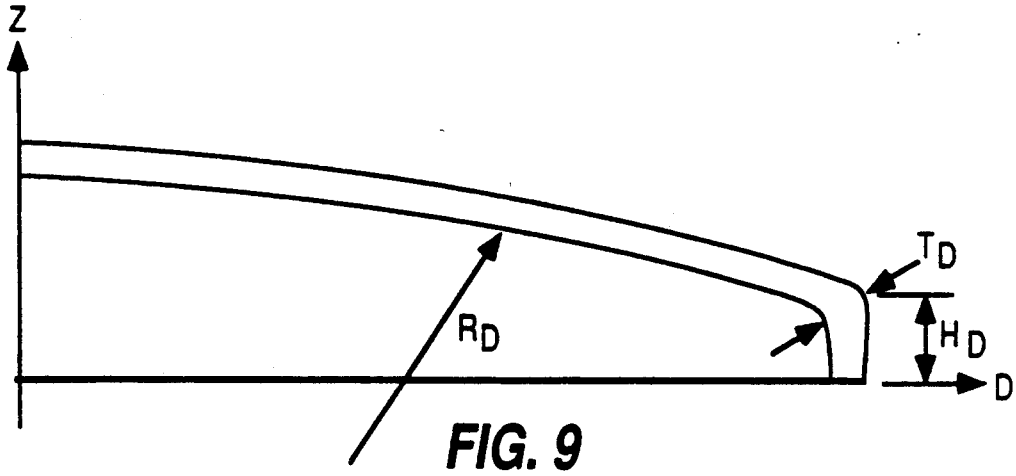

FIGS. 7, 8 and 9 show cross-sections of the faceplate panel 12 along the minor axis Y, the major axis X and the diagonal D, respectively. The thickness of the panel 12 at the junction of the faceplate 18 and sidewall is indicated by the letter T, the height of the sidewall 20 is indicated by the letter H, and the equivalent radius of the inner surface of the faceplate is indicated by the letter R. The heights of the sidewall are related as follows: $H_Y>H_X>H_D$. The thickness of the faceplate increases from the center to the sides of the faceplate. This increase is referred to as wedging. Wedging is added to a faceplate panel to provide the strength needed to withstand atmospheric pressure when the tube is evacuated. The exterior surface of the faceplate is similar in contour to the inner surface, except that the former is slightly less curved because of the addition of wedging to the glass panel.

What is claimed is:

1. In a cathode-ray tube including a rectangular faceplate having two long sides and two short sides, the ratio of the length of said long sides to the lengths of said short sides being approximately 16 to 9, said tube including a major axis which parallels said two long sides and a minor axis which parallels said short sides, the improvement comprising the ratio of the equivalent radius of faceplate curvature along the major axis to the equivalent radius of faceplate curvature along the minor axis being in the approximate range of 1.5 to 1.6, the ratio of the equivalent radius of faceplate curvature along the long sides of the faceplate to the equivalent radius of faceplate curvature along the major axis being in the approximate range of 1.12 to 1.15, and the ratio of the equivalent radius of faceplate curvature along the long sides of the faceplate to the equivalent radius of faceplate curvature along the short sides being in the approximate range of 1.30 to 1.36.

2. In a cathode-ray tube including a rectangular faceplate having two long sides and two short sides, the ratio of the length of said long sides to the length of said short sides being approximately 16 to 9, said tube including a major axis which parallels said two long sides and a minor axis which parallels said short sides, and said tube including a rectangular viewing screen on an inner surface thereof, the improvement comprising said faceplate having an inner surface contour defined by the equation, $$Z=C(1)X^2+C(2)X^4+C(3)Y^2+C(4)X^4Y^2+C(5)Y^4$$

where:

Z is the distance from a plane tangent to the center of the inner surface contour, X and Y represent distances from the center in the directions of the major and minor axes, respectively, C(1) to C(5) are coefficients that depend on the diagonal dimension of the viewing screen on the faceplate.

3. The tube as defined in claim 2, wherein said viewing screen has a diagonal dimension of 66 cm, and the coefficients C(1) to C(5) are approximately equal to the following

| |
|---|
| $C(1) = 0.338678 \times 10^{-03}$ |
| $C(2) = 0.629894 \times 10^{-09}$ |
| $C(3) = 0.603681 \times 10^{-03}$ |
| $C(4) = -0.222411 \times 10^{-13}$ |
| $C(5) = 0.172513 \times 10^{-09}$ |

where the values for X and Y are in millimeters.

4. In a cathode-ray tube including a rectangular faceplate having two long sides and two short sides, the ratio of the length of said long sides to the length of said short sides being approximately 16 to 9, said tube including a major axis which parallels said two long sides and a minor axis which parallels said short sides, and said tube including a rectangular viewing screen on an inner surface thereof, the improvement comprising said faceplate having an inner surface contour defined by the equation, $$Z=C'(1)X^2+C'(2)X^4+C'(3)Y^2+C'(4)X^4Y^2+C'(5)Y^4$$

where:

Z is the distance from a plane tangent to the center of the inner surface contour, X and Y represent distances from the center in the directions of the major and minor axes, respectively, C'(1) to C'(5) are coefficients that depend on the diagonal dimension of the viewing screen on the faceplate and which are defined by the equation, $$C'(I)=K\Sigma C(I)\lambda F^{[J(I)+L(I)-1]}$$

where:

F is a scale factor, equal to the viewing diagonal of the viewing screen of a tube, in cm, divided by 66 cm, K is a factor that changes the curvature of the inside surface contour of the faceplate, J(I) and L(I) are the respective powers of X and Y associated with the coefficients C(1) to C(5), and the coefficients C(1) to C(5) are approximately equal to

| |
|---|
| $C(1) = 0.338678 \times 10^{-03}$ |
| $C(2) = 0.629894 \times 10^{-09}$ |
| $C(3) = 0.603681 \times 10^{-03}$ |
| $C(4) = -0.222411 \times 10^{-13}$ |
| $C(5) = 0.172513 \times 10^{-09}$ |

where X and Y are in millimeters.

5. In a cathode-ray tube including a rectangular faceplate having two long sides and two short sides, the ratio of the length of said long sides to the length of said short sides being approximately 16 to 9, said tube including a major axis which parallels said two long sides and a minor axis which parallels said short sides, and said tube including a rectangular viewing screen on an inner surface thereof, the improvement comprising said faceplate having an inner surface contour defined by the equation, $$Z=\Sigma_I C(I)\Sigma K/F^{J(I)+K(I)-1}\Sigma_X{}^{J(I)}\Sigma_Y{}^{K(I)}$$

where:

Z is the distance from a plane tangent to the center of the inner surface contour, X and Y represent distances from the center in the directions of the major and minor axes, respectively, C(1) to C(5) are coefficients that depend on the diagonal dimension of the viewing screen on the faceplate, F is a scale factor equal to the viewing diagonal of the viewing screen of a tube, in cm, divided by 66 cm, K is a factor that changes the curvature of the inside surface contour of the faceplate, J(I) and L(I) are the respective powers of X and Y associated with the coefficients C(1) to C(5).

* * * * *